United States Patent [19]

Perkins

[11] 4,303,158

[45] Dec. 1, 1981

[54] TOOL BOX

[76] Inventor: Donald R. Perkins, 6 Hammond Rd., Natick, Mass. 01760

[21] Appl. No.: 77,903

[22] Filed: Sep. 24, 1979

[51] Int. Cl.[3] ..... B65D 85/20; A45C 5/12

[52] U.S. Cl. ..... 206/373; 206/803; 312/DIG. 33

[58] Field of Search ..... 206/373, 803; 312/DIG. 33; 220/22.1

[56] References Cited

U.S. PATENT DOCUMENTS

| | | | |
|---|---|---|---|
| 425,215 | 4/1890 | Franklin | 312/DIG. 33 |
| 941,608 | 11/1909 | Benson | 206/803 |
| 1,414,826 | 5/1922 | Meyerson | 206/373 |
| 1,514,885 | 11/1924 | Bigler | 206/373 |
| 2,880,918 | 4/1959 | Schneikhard | 206/373 |
| 2,995,256 | 8/1961 | Schoenfisch | 206/373 |
| 3,259,230 | 7/1966 | Jaeger | 206/373 |
| 3,558,205 | 1/1971 | Mueller | 312/DIG. 33 |
| 3,954,202 | 5/1976 | Petrick | 220/22.1 |
| 4,058,210 | 11/1977 | Mitchell | 206/372 |

FOREIGN PATENT DOCUMENTS

| | | | |
|---|---|---|---|
| 298425 | 10/1928 | United Kingdom | 312/DIG. 33 |

*Primary Examiner*—Joseph Man-Fu Moy

*Attorney, Agent, or Firm*—Irving M. Kriegsman

[57] ABSTRACT

A tool box for small hand tools and associated items which opens up from the front as well as the top and which is provided with supporting elements for holding certain tools contained therein in an upright position. The tool box includes a bottom wall, a back wall, a pair of opposed side walls, a top cover which is hingedly connected at its back edge to the back wall and which is provided with a built-in storage compartment and a front cover which is hingedly connected at its bottom edge to a front plate and which includes a strip magnet on its inside surface on which can be mounted metal tools. A shelf having a plurality of holes into which can be inserted tools and suspended therein in an upright position is mounted inside the tool box near the top and a removable tray having adjustable compartments is seated on a shelf inside the tool box near the bottom. A pull-out drawer having adjustable compartments is located underneath the tray.

The tool box lends iself to an orderly arrangement of the tools and items being stored. In addition when the covers are opened, all of the tools suspended on the shelf near the top and mounted on the strip magnet are clearly visible and easily accessible.

1 Claim, 3 Drawing Figures

TOOL BOX

BACKGROUND OF THE INVENTION

The present invention relates to tool boxes and, more particularly, to tool boxes for holding small hand tools, such as screwdrivers and wrenches and other associated items that may be needed by the user from time to time, such as screws, washers, nuts and bolts.

Tool boxes of the type referred to above are well known in the art and commonly used by handimen and/or servicemen. Such boxes are generally in the form of an elongated rectangularly shaped container having a bottom wall, a back wall, a front wall, a pair of side walls and a cover which is usually hinged to the back wall and which is usually includes a handle so that the tool box can be easily moved from one location to another. One or more trays are usually disposed inside the container. In some tool boxes the trays are removable while in other tool boxes the trays are pivotally mounted so that they can be partially lifted out to gain access to the storage area underneath.

Normally, the user of the tool box will place small sized items in the tray, or trays, if there are more than one, and lay the larger sized items such as the screwdrivers and wrenches on the floor of the container underneath the trays.

Although the trays are normally partitioned into compartments, the size of the compartments is frequently not the proper size needed for the specific items the user wishes to place in the trays. In addition, the space between the trays and the bottom wall, although providing an area in which tools can be stored or stacked, is not constructed such that the tools can be arranged in an orderly fashion. Instead, the tools are simply placed or thrown into the area one on top of the other. As a result, after a period of time the tools and other items in the tool box are simply arranged in two piles, one pile seated on top of the tray or trays and the other pile in the storage area underneath the trays. Since the tools and other items are not arranged in an orderly manner the user of the tool box is forced in many cases to remove most all of the tools in the bottom area until he finds the particualr tool needed at a particular time. This is very time consuming and often very frustrating, especially if the tool is for some unknown reason not even the tool box. In addition, the general tool box construction of one or more trays on the top and a bottom storage area into which can be placed or thrown anything that will not fit into the trays lends itself to an overloading of the tool box with items that are not frequently used.

Accordingly, the need exists for an improvement in the construction of tool boxes for use in holding hand tools and other related items.

SUMMARY OF THE INVENTION

It is an object of this invention to provide a new and improved tool box for use in holding small hand tools and other associated items.

It is another object of this invention to provide a tool box for small hand tools and other associated items in which the tools and other items are arranged therein in an orderly fashion.

It is yet another object of this invention to provide a tool box for small hand tools and other associated items in which the tools and other items are more easily accessible than in conventional tool boxes.

It is yet still another object of this invention to provide a tool box for small hand tools and other associated items which is not as easily susceptible to overloading as conventional tool boxes.

It is another object of this invention to provide a tool box for small hand tools and associated items in which the tools contained therein are not simply stacked in the bottom in a pile.

It is still another object of this invention to provide a tool box for hand tools and associated items, which is compact, portable, easy and inexpensive to manufacture and easy to use.

A tool box constructed according to the teaching of this invention is in the form of a container having a bottom wall, a pair of side walls, a back wall, a top cover hingedly connected at its back edge for swinging movement from an open position to a closed position and a front cover hingedly connected at its bottom edge for swinging movement from a closed position to an open position. A shelf having a plurality of holes into which can be inserted screwdrivers and other similar tools and suspended therein in an upright position is mounted inside the tool box near the top and a tray for holding small items such as screws, washers, or allen wrenches is disposed inside the tool box near the bottom. The top cover is provided with a built-in storage area for holding small items and a carrying handle. A pull out drawer also for holding small items is located underneath the pull out tray. Finally, means are provided on the inside of the front cover for mounting certain types of tools in an upright position.

As is readily apparent, the tools and other items are disposed in the tool box in a completely different manner than conventional tool boxes. In particular, instead of simply lying the tools down in the bottom in a horizontal position, the tools are mounted inside the box on either the shelf near the top or on the inside of the front cover in a vertical or upright position. When the covers are opened all the tools so mounted are clearly visible and easily accessible. On the other hand, the small items are stored either in the pull out drawer, the removable tray, or the storage area inside the top cover. Thus the likelihood of overloading or random of stacking of tools and other items within the tool box is greatly decreased.

The foregoing and other objects and advantages will appear from the description to follow. In the description, reference is made to the accompanying drawing which forms a part thereof, and in which is shown by way of illustration a specific embodiment for practicing the invention. This embodiment will be described in sufficient detail to enable those skilled in the art to practice the invention, and it is to understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described by way of example, with reference to the drawings wherein like reference numerals represent like parts and wherein.

DESCRIPTION OF PREFERRED EMBODIMENT

Figure 1:
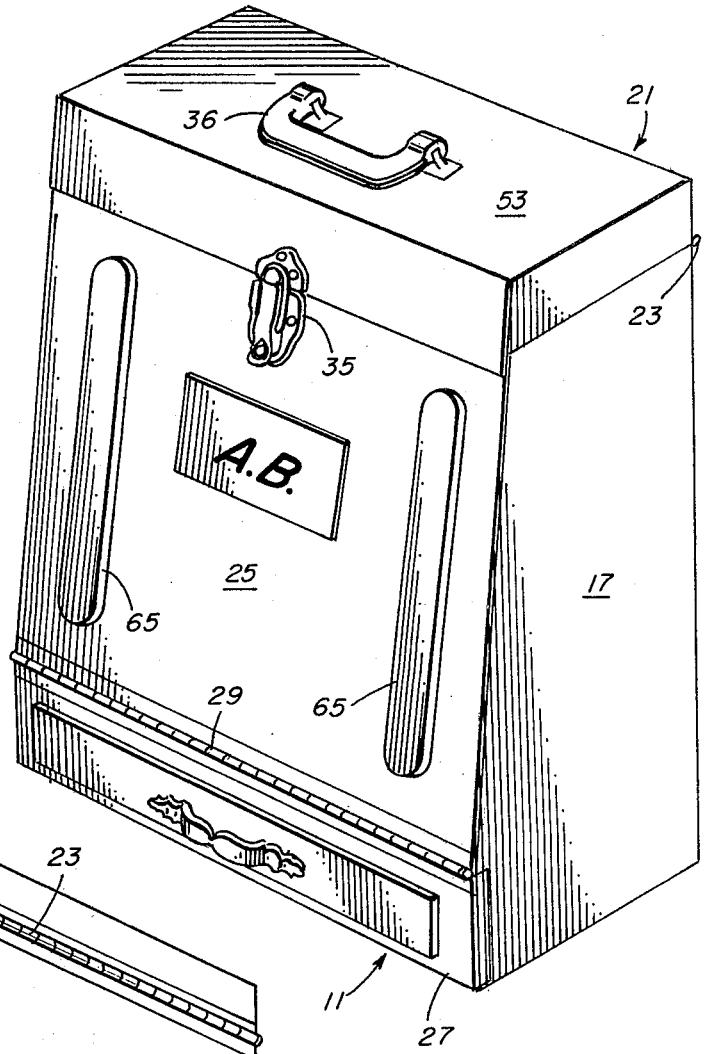
FIG. 1 is a perspective view taken from the front of a tool box constructed according to the teachings of this invention with the covers closed.
Figure 2:
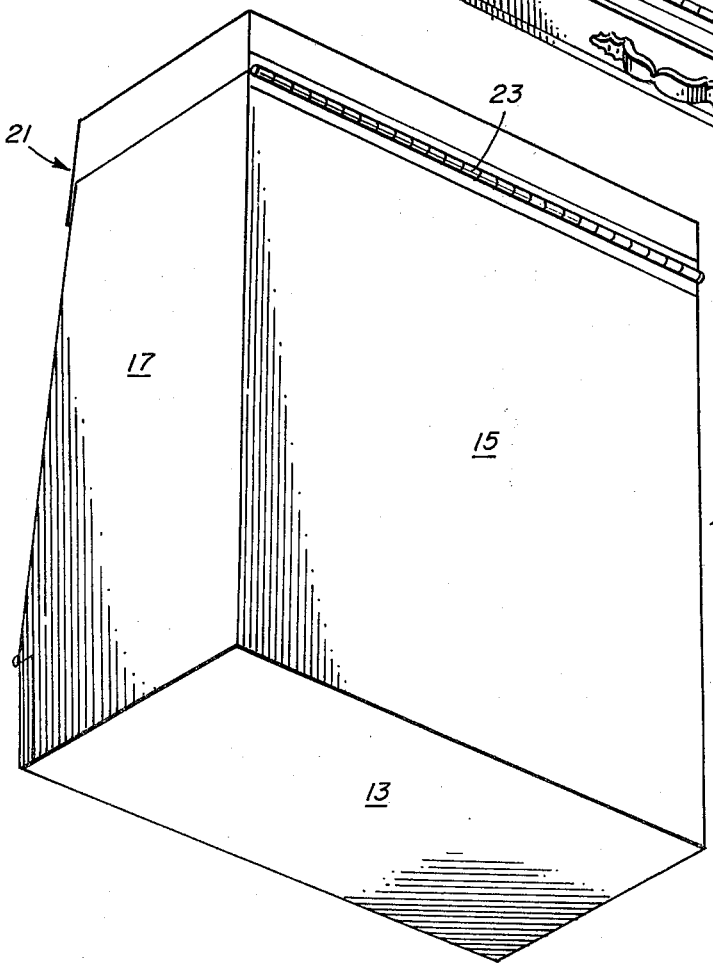
FIG. 2 is a perspective view of the tool box illustrated in FIG. 1 taken from the back.
Figure 3:
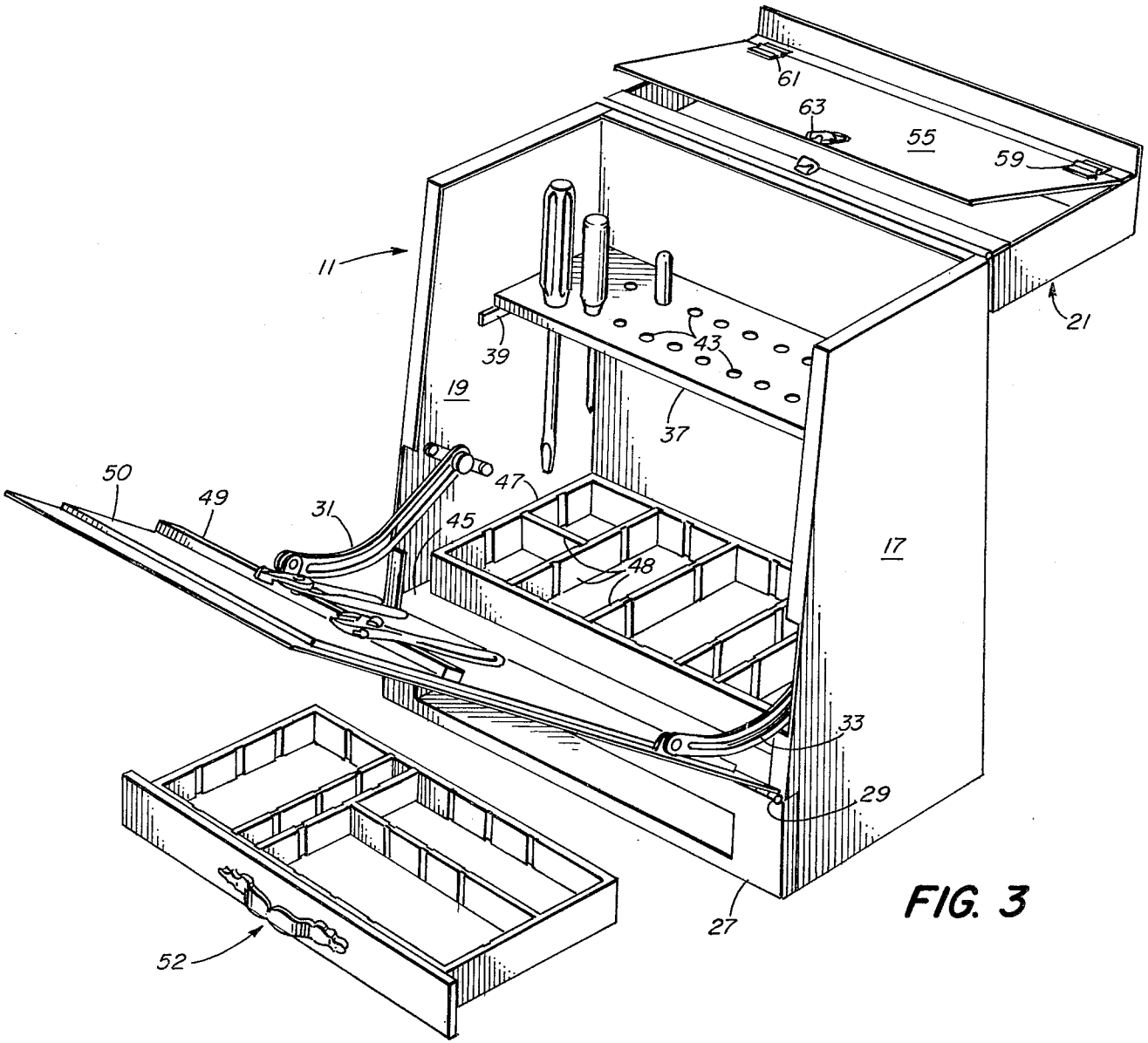
FIG. 3 is a perspective view partially exploded of the tool box illustrated in FIG. 1 with the covers open.

Referring now to the drawings, there is illustrated a preferred embodiment of a tool box constructed according to the teachings of this invention and identified generally by reference numeral 11.

Tool box 11 is in the form of a container like structure having a generally rectangular bottom wall 13, a generally rectangular back wall 15 and a pair of opposed trapezoidal shaped side walls 17 and 19. A generally rectangular, top cover 21 is pivotally connected at its back edge to the top of back wall 15 by a piano hinge 23 and a generally rectangular front cover 25 is pivotally connected at its lower edge to a front plate 27 by another piano hinge 29. Front cover 25 is also connected to side walls 17 and 19 by a pair of friction lid hinges 31 and 33 respectively, which limits the amount by which front cover 25 can be opened and which also add to the overall strength of the structure. Front cover 25 and top cover 21 are secured to each other when in a closed position by a suitable latch 35.

Bottom wall 13, back wall 15, the two sidewalls 17 and 19, the two covers 21 and 25 and the front plate 27 collectively form a chamber for receiving and holding the various tools and the other items. The component parts of the chamber are made of sturdy, rigid material such as stainless steel or wood and are secured to each other by any suitable means such as rivets or screws.

Front cover 25 is provided with a carrying handle 36.

Located inside the chamber near the top but spaced downward therefrom a distance of about four inches or more is a shelf or rack 37 made of wood, metal, plastic or other suitable sturdy material. Shelf 37 is mounted on brackets 39 which are rigidly attached to side walls 17 and 19 by screws, rivets or other suitable means. Shelf 37 is formed with a plurality of holes or slots 43 into which can be inserted screwdrivers, wrenches or other similar tool and suspended therein in a vertical position. Slots 43 are preferably different sizes and shapes so as to accomodate different sized tools. Shelf 37 is preferably mounted on brackets 39 and 41 by snap-in brackets (not shown) so that it can be removed when desired.

Located inside the chamber near the bottom but spaced upward therefrom a distance on the order of three inches or more is a shelf 45 which is mounted on brackets (not shown) attached to sidewalls 17 and 19. Seated on top of shelf 45 is a removable tray 47 which can be used for the storage of small articles such as screws, washers, wrench heads, etc. Tray 47 includes a plurality of different sized slotted partition members 48 which are adapted to be inserted into slots formed around the periphery of tray 47 to form different sized, that is adjustable, compartments.

Mounted on the inside of front cover 25 by rivets or other suitable means is a strip magnet 49 on which can be mounted and held by magnetic attraction various types of metallic tools such as screwdrivers etc. A panel of pressed board 50 is sandwiched between strip magnet 49 and front cover 25 to insulate the strip magnet 49 from front cover 25. In an alternate embodiment of the invention a plurality of eye hooks can be inserted in place of the strip magnet.

A drawer 51 is located underneath shelf 45 and is movable into and out of the space between shelf 45 and bottom wall 13 through an appropriately sized opening in front plate 27. Drawer 51 may include adjustable compartments similar to shelf 37 and may be used for the storage of small articles such as socket heads or gages.

Top cover 21 includes an outer plate 53 and an inner plate 55 which is spaced from the outer plate 53 a distance of about two inches and is connected to a support plate 57 by a pair of hinges 59 and 61. The area between the two plates 53 and 55 defines a compartment in which can be stored various types of small items. The end of plate 55 opposite the end containing the hinges 59 and 61 is releasably secured to support plate 57 by a slide bolt type latch 63.

Thus, when used properly, tools can be mounted either on rack 37 or strip magnet 49 while small items can be stored either in tray 47, drawer 51 or the compartment in top cover 21.

As can be appreciated, when the two covers are opened all of the tools hanging or suspended from rack 37 or strip magnet 49 as well as the items in tray 47 are clearly visible and easily accessible.

Finally, tool box 11 may include decorative plates 65 to enhance its appearance.

It will be understood that various changes in the details, materials, and arrangement of parts which have hereinafter been described and illustrated in order to explain the nature of the invention may be made by those skilled in the art within the principles and scope of the invention.

What is claimed is:

1. A tool box for screwdrivers, wrenches other small hand tools and other associated articles comprising a box-like structure having:

a. a bottom wall, b. a back wall, c. a pair of opposed trapezoidally shaped side walls, d. a top cover hingedly connected at its back edge for swinging movement from an open position to a closed position, said top cover including a storage compartment having a cover hingedly connected to said top cover for holding small articles and a carrying handle, e. a front wall, f. a front cover located above the front wall hingedly connected at its bottom edge to the top of the front wall for swinging movement from an open position to a closed position, g. latch means for securing the top cover to the front cover, h. a lower shelf for supporting a tray, i. an upper shelf having a plurality of openings into which can be inserted screwdrivers or similar tools and maintained therein in an upright position, j. a pair of friction lid hinges connected between said front cover and said side walls for limiting movement of said front cover, k. a removable tray adapted to be mounted on said lower shelf and having compartments adjustable in size, l. a pull-out drawer having adjustable compartments located underneath the lower shelf and removable from the front of the tool box, and m. magnetic means on the inside of said front cover for supporting tools and the like in an upright position.

* * * * *